United States Patent [19]

Mokadam

[11] Patent Number: 4,598,556

[45] Date of Patent: Jul. 8, 1986

[54] HIGH EFFICIENCY REFRIGERATION OR COOLING SYSTEM

[75] Inventor: Raghunath G. Mokadam, Rockford, Ill.

[73] Assignee: Sundstrand Corporation, Rockford, Ill.

[21] Appl. No.: 651,308

[22] Filed: Sep. 17, 1984

[51] Int. Cl.[4] ..... F25B 5/00

[52] U.S. Cl. ..... 62/117; 62/200

[58] Field of Search ..... 62/115, 198, 199, 200, 62/102, 114, 117, 513, 113

[56] References Cited

U.S. PATENT DOCUMENTS

| | | | |
|---|---|---|---|
| 3,203,194 | 8/1965 | Fuderer | 62/114 |
| 3,277,659 | 10/1966 | Sylvan et al. | 62/114 |
| 3,768,273 | 10/1973 | Missimer | 62/84 |
| 3,889,485 | 6/1975 | Swearingen | 62/54 |
| 3,950,961 | 4/1976 | Lotz | 62/198 |
| 3,964,891 | 6/1976 | Krieger | 62/9 |
| 4,089,186 | 5/1978 | Rojey et al. | 62/101 |
| 4,251,247 | 2/1981 | Gauberthier et al. | 62/9 |
| 4,254,630 | 3/1981 | Geary | 62/238.6 |
| 4,268,291 | 5/1981 | Cann | 62/198 |
| 4,285,205 | 8/1981 | Martin et al. | 62/199 |
| 4,303,427 | 12/1981 | Krieger | 62/9 |
| 4,316,366 | 2/1982 | Manning | 62/200 |
| 4,341,084 | 7/1982 | Rojey et al. | 62/101 |
| 4,389,855 | 6/1983 | Ueda et al. | 62/200 |

*Primary Examiner*—Ronald C. Capossela

*Attorney, Agent, or Firm*—Wood, Dalton, Phillips, Mason & Rowe

[57] ABSTRACT

A refrigeration/cooling system including a compressor (12, 14, 16, 18) having an inlet (54) and an outlet (20), a countercurrent condenser (24) connected to the compressor outlet (20) and an countercurrent evaporator (30) connected to the compressor inlet (54). A heat exchanger (36) interconnects the condensor (24) and the evaporator (30). A first throttling valve (34) is interposed between the heat exchanger (36) and the evaporator (30) and a second throttling valve (64) is located in the system downstream of the condenser (24) and upstream of the evaporator (30) for providing an at least partially expanded refrigerant to the heat exchanger (36). A refrigerant return (50) interconnects the heat exchanger (36) and a portion of the compressor (16) for returning the partially expanded refrigerant to the compressor.

13 Claims, 3 Drawing Figures

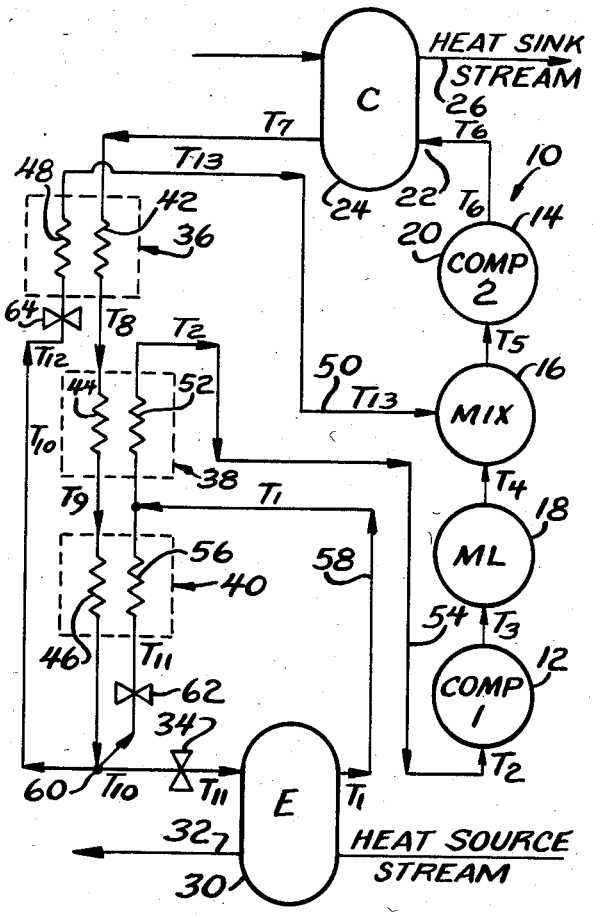
FIG. 1
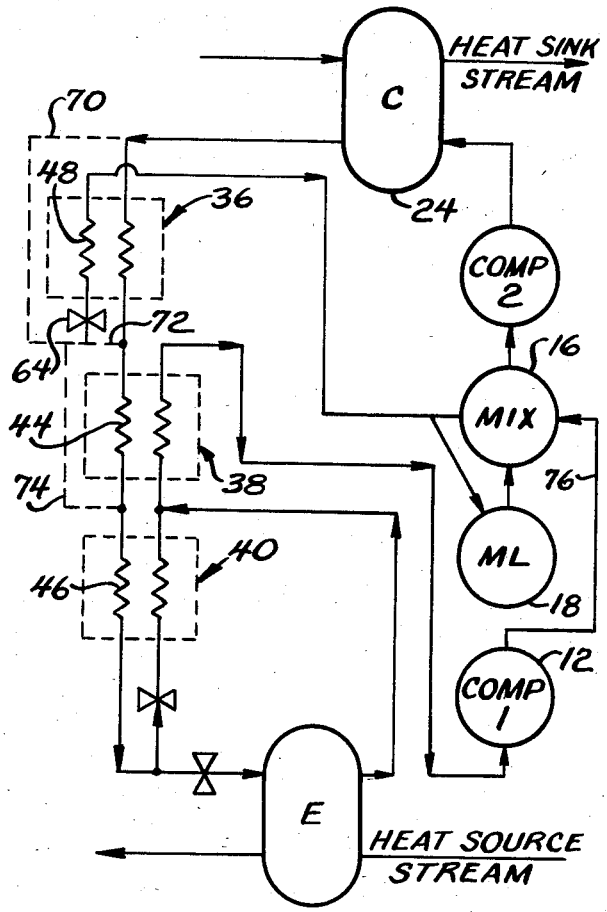
FIG. 3
FIG. 2
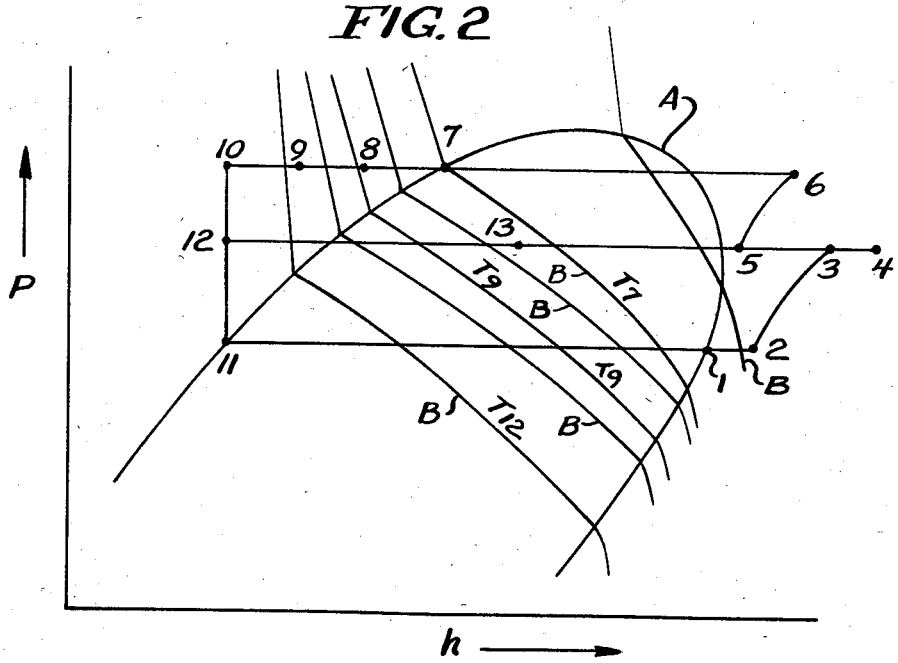

HIGH EFFICIENCY REFRIGERATION OR COOLING SYSTEM

FIELD OF THE INVENTION

This invention relates to a high efficiency vapor compressor refrigeration or cooling system which preferably, though not necessarily, employs a non-azeotropic binary fluid.

BACKGROUND OF THE INVENTION

Refrigeration or cooling systems generally use a single refrigerant in a vapor compressor cycle. In such a case, the phase change of the refrigerant in the evaporator and in the condenser will be at constant temperature for all practical purposes.

In the usual case, a mismatch leading to poor performance from the efficiency standpoint occurs. For in general, the heat source stream (the stream being cooled) in the evaporator and the heat sink stream (the stream cooling the refrigerant) in the condenser exchange heat sensibly, that is, without regard to the latent heat of fusion and/or vaporization of the material forming such heat streams.

As a consequence, as the heat source stream passes through the evaporator, its temperature continuously decreases while as the heat sink stream passes through the condenser, its temperature continually increases, both toward the temperature value of the system refrigerant at that particular location in the system.

As is well known, the rate of heat transfer in a given system is proportional to the temperature differential. Consequently, as heat source stream or heat sink stream temperatures approach refrigerant temperature, the rate of heat transfer slows.

In order to avoid insufficient rates of heat transfer, such systems have conventionally utilized relatively large blowers or fans to rapidly move the heat sink stream through the condenser to maintain desirably high temperature differentials.

Of course, work must be expended to generate the relatively high flow rates of such fluid stream and such has a negative effect on system efficiency.

The present invention is directed to overcoming one or more of the above problems.

SUMMARY OF THE INVENTION

It is the principal object of the invention to provide a new and improved refrigeration/cooling system. More specifically, it is object of the invention to provide such a system that minimizes the work required to direct a heat sink fluid across a condenser while maintaining a sufficient temperature differential to obtain good heat exchange to thereby increase system efficiency.

An exemplary embodiment of the invention achieves the foregoing object in a system including a compressor having an inlet and an outlet. A condenser is connected to the compressor outlet and an evaporator is connected to the compressor inlet. A heat exchanger interconnects the condenser and the evaporator and first throttling means are interposed between the heat exchanger and the evaporator. Means are included for providing an at least partially expanded refrigerant to the heat exchanger and such means include a second throttling means connected in the system downstream of the condenser and upstream of the evaporator. A refrigerant return interconnects the heat exchanger and the compressor inlet for returning the expanded refrigerant to the compressor.

In a highly preferred embodiment, the system includes a refrigerant which is a non-azeotropic binary fluid and the system is free of phase separators. The condensor and evaporator have counter current flow paths The invention contemplates the use of a multiple stage compressor, that is, one wherein expanded refrigerant may be introduced at differing pressures. The refrigerant from the heat exchanger is introduced at a higher pressure than the refrigerant taken from the evaporator to thereby minimize the work required in compressing the refrigerant to a desired level prior to condensation thereof.

The invention also contemplates a method of providing for refrigeration or cooling including the steps of compressing a refrigerant fluid in a compressor; condensing the compressed fluid; cooling the fluid resulting from the condensing step by expanding a portion of the condensed fluid, bringing the expanded portion in heat exchange relation with the condensed fluid and returning the expanded portion to the compressor. There follows a further cooling step wherein the cooled fluid resulting from the step preceding is cooled by expanding a portion of the further cooled fluid, bringing the expanded portion of the further cooled fluid into heat exchange relation with the further cooled fluid and returning the expanded portion of the further cooled fluid to the compressor at a pressure lower than that of the expanded portion of the condensed fluid.

The further cooled fluid is then expanded in an evaporator to provide cooling or refrigeration and thereafter is returned to the compressor at the pressure at which the expanded portion of the further cooled fluid is returned to the compressor.

The fluid expanded in the initial cooling step can be taken directly from the condenser, or from the fluid resulting from the first cooling step, or from the fluid resulting from the further cooling step, as desired.

Other objects and advantages of the invention will become apparent from the following specification taken in connection with the accompanying drawings.

DESCRIPTION OF THE DRAWINGS

FIG. 1 is a schematic showing a refrigeration/cooling system made according to the invention;

FIG. 2 is a pressure versus enthalpy diagram showing system operation when refrigerant is a non-azeotropic binary fluid; and FIG. 3 is a schematic illustrating possible modifications of the system.

DESCRIPTION OF THE PREFERRED EMBODIMENT

An exemplary embodiment of a refrigeration/cooling system made according to the invention is illustrated in FIG. 1 and is seen to include a compressor, generally designated 10. The compressor will typically be of the sort that can receive refrigerant to be compressed at two different pressure levels. This, of course, means that the compressor 10 may be a multiple stage compressor or, in the alternative, a compressor of the sort wherein the higher pressure refrigerant is added to the lower pressure refrigerant at some point after the initiation of the compression of the latter. For convenience, however, as illustrated in FIG. 1, a multiple stage compressor is shown which includes a first compression stage 12 and a second compression stage 14. Interposed between the compression stages 12 and 14 is a mixer 16 whereat relatively high pressure refrigerant is mixed with partially compressed relatively low pressure refrigerant from the stage 12 prior to its admission to the compressor stage 14. For thermodynamic completeness, the compressor 10 is illustrated as having a motor shown at a block 18, which is cooled by the refrigerant. The system components cooled at the block 18 need not be limited to a motor. For example, system control components or electronics can be among those cooled at the block 18.

The compressor 10 includes an outlet 20 which is connected to the inlet 22 of a countercurrent condenser 24. In the usual case, air will be flowed through the condenser 24 oppositely of the flow of refrigerant and as indicated by an arrow 26 bearing the legend "heat sink stream". The air will, of course, cool the compressed refrigerant to cause the same to condense within the condenser 24.

The embodiment of the invention illustrated in FIG. 1 also includes an evaporator 30. The evaporator 30 is a countercurrent evaporator through which a heat source stream, such as air if used for air conditioning, is flowed in the direction of arrows 32 bearing the legend "heat source stream". Condensed refrigerant is throttled by a valve 34 prior to its admission to the evaporator 30 whereat it is evaporated to absorb heat from the heat source stream.

According to the invention, there is further included first, second and third heat exchangers, generally designated 36, 38, and 40. As illustrated in the drawings, the heat exchangers 36, 38 and 40 are separate but those skilled in the art will readily appreciate from the description that follows that the same could be commonly housed or even one continuous heat exchanger so long as the flow path connections to be described are maintained.

The heat exchanger 36 includes one fluid flow path 42 through which condensed refrigerant from the condenser 24 is flowed. This flow path is connected serially to a similar flow path 44 in the second heat exchanger 38; and this is in turn connected to a flow path 46 in the third heat exchanger 40.

The flow path 42 in the heat exchanger 36 is in heat exchange relation with a coolant flow path 48. The flow paths 42 and 48 are in countercurrent relation and the latter is connected by a return line 50 to the mixer 16 forming part of the compressor 10.

The second heat exchanger 38 has a similar coolant flow path 52 which is connected by a return line 54 to the inlet of the first compressor stage 12.

The third heat exchanger 40 has a similar coolant flow path 56 which is connected as an input to the coolant flow path 52. Additionally, fluid from the evaporator 30 is inputted to the flow path 52 via a line 58.

Condensed refrigerant from the condenser 24 is initially cooled in the heat exchanger 36, further cooled in the heat exchanger 38, and even further cooled in the heat exchanger 46. Following the third stage of cooling, the condensed refrigerant is directed to a point 60 whereat it is split into three streams. The first of the streams is directed through the throttling valve 34 to the evaporator 30. A second of the streams is directed through a throttling valve 62 to the coolant flow path 56 of the third heat exchanger 40. Because the coolant emerging from the flow path 56 is recombined with the fluid from the evaporator 30 prior to entry into the coolant flow path 52 of the second heat exchanger 38, the throttling action provided by the valves 34 and 62, from the pressure standpoint, is essentially identical. However, mass flow rates differ substantially, there being a much greater flow rate of the refrigerant through the evaporator 30 than through the flow path 56.

A third stream of condensed refrigerant is taken from the point 60 and throttled by a throttling valve 64 prior to its introduction into the coolant flow path 48 of the first heat exchanger 36. The throttling valve 64 does not reduce the pressure of the condensed refrigerant to the same extent as the valves 34 and 60 since the condensed refrigerant to be cooled is at a hotter temperature at the first heat exchanger 36 than later in its flow path with the consequence that adequate cooling of the same can be obtained with only partial expansion at a higher pressure, although the pressure will, of course, be less than the pressure of the refrigerant as it leaves the compressor 10 or the condenser 24.

It should be noted that the throttled refrigerant from the valve 64 need not be immediately directed to the heat exchanger flow path 48. Rather, it could be directed to, for example, the motor represented by the block 18 for cooling purposes and then returned to the heat exchanger 36, and finally returned to the compressor at an appropriate stage via the line 50.

While the system will provide increased efficiency where a single refrigerant is used, greater advantage may be realized if a non-azeotropic binary fluid is utilized as a refrigerant. FIG. 1 illustrates, at various points in the system, the fluid temperature with the designations "T" followed by a subscript for system operation using such a non-azeotropic binary fluid, the significance of which will become apparent.

It should be observed that the presence of the heat exchanger 36 is essential to the invention in all cases whereas the presence of the heat exchanger 40 is essential only in the case where a non-azeotropic binary fluid is being employed as a refrigerant. The heat exchanger 38 is not at all essential and can be dispensed with entirely if even a small degree of super heating of the refrigerant, after evaporation, occurs in the evaporator 30.

Turning now to FIG. 2, the same illustrates the vapor compression cycle of the preferred embodiment illustrated in FIG. 1 when a non-azeotropic binary fluid is employed as the refrigerant. FIG. 2 shows a plotting of pressure versus enthalpy. A representative "vapor dome" line is shown at A and a series of constant temperature lines are shown at B. Of course, the exact configuration of the vapor dome A and the constant temperature lines B will depend upon the precise binary fluid being employed.

Because of the nature of a non-azeotropic binary fluid, as is well known, its bubble point temperature will vary depending upon the proportion of one constituent to another in the mixture. Thus, if such a fluid exists as a saturated liquid, the application of additional heat to provide the heat of vaporization at a constant pressure will result in one of the constituent materials vaporizing initially at a more rapid rate than the other. This in turn increases the concentration of the other constituent in the liquid phase and if the liquid phase is to remain saturated, the bubble point must necessarily increase. The converse is, of course, true when a saturated vapor of a non-azeotropic binary fluid is being condensed.

The present invention makes use of this phenomena to maximize efficiency through the use of countercurrent heat exchange devices. By selecting a non-azeotropic binary fluid for the refrigerant whose characteristics in a particular heat exchange device match heat exchange characteristics of the heat sink stream or the heat source stream, as the case may be in the heat exchanger, desired temperature differentials between the fluids can be maintained throughout their entire residence of time in such exchanger. Thus, the in case of the condenser 22, the refrigerant enters at a relatively high temperature and leaves at a lower temperature. The heat sink stream enters at a low temperature and leaves at a higher temperature. Because the entering heat sink stream is at its lower temperature when brought into heat exchange relation with the emerging refrigerant, which is also at its lowest temperature, a desirable temperature differential is maintained. Similarly, because the heat sink stream emerges at its highest temperature at the same time the refrigerant is entering at its highest temperature, the desirable temperature differential is also maintained; and it will be readily apparent that such temperature differential, although varying if desired, is maintained throughout.

A typical cycle is as follows. The compressed vapor, usually typically superheated, emerges from the compressor at a temperature indicated at point 6. It is cooled at constant pressure in the condenser 24 until condensation is complete at point 7. It will be appreciated that the desired temperature drop is achieved.

According to the invention, the condensed refrigerant is cooled in the first stage heat exchanger 36 at constant pressure as indicated by that portion of the line extending between points 7 and 8. The cooling provided by the second stage heat exchanger 38 also occurs at constant pressure and is represented by that portion of the line between points 8 and 9. The third and final cooling provided by the third stage heat exchanger 40 is represented by that portion of the lines 9 and 10.

Thereafter, expansion of the cooled refrigerant occurs. Such throttling as is provided by the valves 34 and 62 is represented by the line 10-11, the latter point indicating the lowest pressure in the system. At this point, the refrigerant is essentially as a saturated liquid for the example of concern. The evaporation of the refrigerant occurs in the evaporator 30 and is represented by the line 11-1 in FIG. 2. At point 1, refrigerant exists as a saturated vapor at a higher temperature than it was at when it existed as a saturated liquid. Thus, the desired change in temperature across the evaporator necessary to provide the desired temperature differential with the countercurrently flowing heat source stream is provided.

Some superheating of the vapor occurs in the second heat exchanger 38 as represented by the line 1-2. The first stage of compression is illustrated by the line 2-3 and the heat added to the fluid, at constant pressure, due to the motor loss, i.e. cooling of the motor shown at block 18 in FIG. 1 is represented by the line 3-4. In practice, however, there may be a pressure drop across the motor such that the line 3-4 represents a theoretical or ideal situation.

It will be recalled that the portion of the condensed stream expanded through the throttling valve 64 is not expanded to the relatively low pressure found at the outlet of the throttling valves 34 and 62. Thus, the throttling occurring at the valve 64 is represented by the line 10-12 which halts at a higher pressure level than expansion elsewhere. In a typical system, the throttling represented by the line 10-12 need not be entirely due to action of the valve 64. Some throttling may be provided by a pressure drop in the heat exchanger 36 itself or in the motor shown at block 18 if included in the circuit including the heat exchanger 36 as mentioned previously. Partial evaporation necessary to provide cooling in the first heat exchanger 36 is represented by the line 12-13.

In the mixer 16, the partially evaporated fluid emanating from the heat exchanger 36 and block 18 is mixed with the partially compressed fluid at constant pressure. This is shown at line 13-5 in FIG. 2, the partially compressed fluid being cooled as designated by line 4-5.

The final compression stage is then indicated by line 5-6.

As a consequence of the foregoing, it will be appreciated that desired temperature differentials, which may be relatively constant, are maintained throughout the various heat exchange devices so it is not necessary to increase the flow rate of the heat sink stream in order to maintain them. Consequently, the energy that would otherwise be required to increase such flow rates is saved.

It will also be appreciated that the unique use of the heat exchanger 36 and the partial expansion achieved through the use of the throttling valve 64 provides increased efficiency of operation. In particular, because the coolant passing through the coolant flow path 48 in the heat exchanger 36 is expanded only to an intermediate pressure between maximum system pressure and minimum system pressure, less work is required to compress that portion of the stream after its expansion to bring it up to the maximum system pressure prior to its entry into the condenser 24. Because the heat exchanger 36 is located in the system immediately following the condenser 24, the condensed refrigerant will be at its final temperature while existing as a saturated liquid. Consequently, to attain the desired temperature differential necessary to provide the desired cooling effect, the temperature of the coolant in the coolant flow path 48, on the average, may be higher than coolant in the coolant flow paths 52 or 56 which, of course, means that the pressure of the coolant in the flow path 48 may likewise be higher.

FIG. 3 illustrate modifications that may be employed if desired. Where like components are utilized, they are given the same references numerals as in the previous description for simplicity.

According to one modification, the refrigerant directed to the coolant flow path 48 in the heat exchanger 36 is taken directly from the output of the condenser 24 along a conduit 70, shown in dotted form to the upstream of the throttling valve 64. This modification is not quite as efficient as that previously described since the cooling effect on the refrigerant provided by the heat exchange stages 36, 38 and 40 is omitted.

As another alternative, the refrigerant to be expanded in the coolant flow path 48 may be taken from the interface of the heat exchangers 36 and 38 as shown by a dotted line 72. As still another alternative, the refrigerant to be expanded by the throttling valve 64 in the coolant flow path 48 may be taken from the interface of the heat exchange stages 38 and 40 as indicated by a dotted line 74.

Any one of the foregoing modifications may be employed as systems capabilities dictate.

Still another modification is illustrated in FIG. 3. According to this modification, the mixer 16 receives the partially compressed refrigerant from the first compressor stage 12 via a line 76 while the partially expanded refrigerant from the coolant flow path 48 of the first heat exchange stage 36 is directed to the motor 18 for cooling the same prior to its being combined with the partially compressed stage in the mixture 16. Where this modification is employed, care must be taken to prevent any refrigerant in the liquid phase from entering the stator-rotor air gap in the motor 18 since such could cause high viscous drag losses.

From the foregoing, it will be appreciated that a refrigeration/cooling system made according to the invention provides high efficiency of operation, particularly where a non-azeotropic binary fluid is employed as a refrigerant. The unique use of the heat exchanger 36 for cooling the condensed refrigerant with a partially expanded fluid existing at a pressure well above the lowest system pressure minimizes the work required by the compressor to bring such fluid back up to maximum system pressure and thus provides efficiency for both a single refrigerant fluid or a non-azeotropic binary fluid as utilized.

It will also be appreciated that the system of the present invention is considerably simplified over prior art systems and in particular, omits any need for the use of phase separators as required in prior art cooling systems utilizing a non-azeotropic binary fluid. Thus, high efficiency is attained but at lower system cost and bulk.

I claim:

1. A refrigeration/cooling system comprising:

a compressor having an inlet and an outlet;

a countercurrent condenser connected to said compressor outlet;

a countercurrent evaporator connected to said compressor inlet;

a heat exchanger interconnecting said condenser and said evaporator;

first throttling means interposed between said heat exchanger and said evaporator;

means for providing an at least partially expanded refrigerant to said heat exchanger and including a second throttling means connected in said system downstream of said condenser and upstream of said evaporator; and a refrigerant return interconnecting said heat exchanger and said compressor inlet for returning said at least partially expanded refrigerant to said compressor.

2. The refrigeration/cooling system of claim 1 further including a refrigerant in said system, said refrigerant being a non-azeotropic binary fluid, said system being free of phase separators.

3. The refrigeration/cooling system of claim 1 wherein said compressor is a multiple stage compressor.

4. A refrigeration/cooling system comprising:

a compressor for compressing a refrigerant and having plural inlets for receiving refrigerant at differing pressures;

a condenser for condensing refrigerant received from said compressor;

an evaporator, including throttling means, for evaporating condensed refrigerant received from said condenser;

a heat exchanger for cooling condensed refrigerant from said condenser prior to its receipt by said evaporator;

means for providing a coolant to said heat exchanger including means for splitting the stream of condensed refrigerant from said condenser without altering its composition and for providing a first portion to said evaporator and a second, at least partially expanded portion to said heat exchanger; and separate returns for said heat exchanger and said evaporator for returning said portions to respective inlets for said compressor.

5. The refrigeration/cooling system of claim 4 further including an additional heat exchanger for further cooling condensed refrigerant received from said heat exchanger prior to its receipt by said evaporator, said additional heat exchanger being provided with coolant by the return for said evaporator.

6. The refrigeration/cooling system of claim 4 further including an additional heat exchanger for further cooling condensed refrigerant received from said heat exchanger prior to its receipt by said evaporator, said additional heat exchanger being provided with coolant by an at least partially expanded further split portion of said stream of condensed refrigerant.

7. The refrigeration/cooling system of claim 6 wherein said splitting means is located between said additional heat exchanger and said evaporator and wherein said evaporator portion and said additional split portion are united downstream of both said additional heat exchanger and said evaporator at said evaporator return.

8. A refrigeration/cooling system comprising:

a compressor having an outlet and two inlets, each for receiving a refrigerant at a different pressure;

a countercurrent condenser connected to said outlet;

at least first, second and third heat exchange stages defining a serially connected flow path for condensed refrigerant received from said condenser and a number of coolant flow paths equal to the number of stages;

flow splitting and throttling means at the end of said flow path of condensed refrigerant into three throttled portions;

an evaporator receiving a first of said throttled portions;

means directing another of said throttled portions to the coolant path associated with said first stage and then to a relatively higher pressure inlet for said compressor;

means for directing a third of said portions to the coolant flow path associated with the third of said stages; and means downstream of the coolant flow path associated with said third stage for combining said first and third portions and directing said combined portion to the coolant path associated with said second stage and then to the relatively lower pressure inlet of said compressor.

9. The refrigeration/cooling system of claim 8 further including a refrigerant, said refrigerant comprising a non-azeotropic binary fluid.

10. A method of refrigerating or cooling by vapor compression of a non-azeotropic binary fluid comprising the steps of (a) compressing the fluid in a compressor;

(b) condensing the compressed fluid;

(c) cooling the fluid resulting from step (b) by (1) expanding a portion of the condensed fluid, (2) bringing said expanded portion into heat exchange relation with the fluid resulting from step (b) and (3) returning said expanded portion to said compressor;

(d) further cooling the cooled fluid resulting from step (c) by (1) expanding a portion of the further cooled fluid, (2) bringing said expanded portion of said further cooled fluid into heat exchange relation with the cooled fluid resulting from step (c), and (3) returning said expanded portion of said further cooled fluid to said compressor at a pressure lower than that of said expanded portion of said condensed fluid;

(e) evaporating said further cooled fluid in an evaporator to provide cooling or refrigeration and (f) returning the fluid resulting from step (e) to the compressor with the returned fluid of step (d).

11. The method of refrigerating or cooling of claim 10 wherein the fluid expanded in step (c)(1) is condensed further cooled fluid resulting from step (d).

12. The method of refrigerating or cooling of claim 10 wherein the fluid expanded in step (c)(1) is condensed cooled fluid resulting from step (c).

13. The method of refrigerating or cooling of claim 10 wherein the fluid expanded in step (c)(1) is condensed fluid resulting from step (b).

* * * * *